US007604517B2

(12) United States Patent
Hsieh et al.

(10) Patent No.: US 7,604,517 B2
(45) Date of Patent: Oct. 20, 2009

(54) ELECTRICAL TERMINAL

(75) Inventors: Wayne Hsieh, Tu-Cheng (TW); Ke-Hao Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/825,884

(22) Filed: Jul. 9, 2007

(65) Prior Publication Data

US 2008/0009162 A1 Jan. 10, 2008

(30) Foreign Application Priority Data

Jul. 7, 2006 (CN) ..... 200620074674

(51) Int. Cl.
*H01R 13/40* (2006.01)

(52) U.S. Cl. ..... 439/733.1

(58) Field of Classification Search ..... 439/733.1, 439/444, 869

See application file for complete search history.

(56) References Cited

U.S. PATENT DOCUMENTS

| | | | | | |
|---|---|---|---|---|---|
| 2,597,262 | A * | 5/1952 | Roger | 439/459 |
| 3,444,504 | A * | 5/1969 | Wyman et al. | 439/248 |
| 3,621,444 | A * | 11/1971 | Stein | 439/109 |
| 3,699,505 | A * | 10/1972 | Bruner | 439/389 |
| 5,984,735 | A * | 11/1999 | Daoud | 439/733.1 |
| 6,743,059 | B1 * | 6/2004 | Korsunsky et al. | 439/733.1 |
| 2004/0219841 | A1 * | 11/2004 | Yamashita | 439/733.1 |

* cited by examiner

*Primary Examiner*—Phuong K Dinh
(74) *Attorney, Agent, or Firm*—Andrew C. Cheng; Wei Te Chung; Ming Chieh Chang

(57) ABSTRACT

A conductive contact (5) includes a right base portion (51), a securing portion (51) extending from a lower end of the base portion (51), wherein the securing portion (53) defines at least one barb (531) with a side of the securing portion (53) angled an angle less than 90 to a vertical direction, providing a more strengthened engagement between the housing and the contact (5).

6 Claims, 4 Drawing Sheets

(PROIR ART)

ELECTRICAL TERMINAL

FIELD OF THE INVENTION

The present invention relates to a contact, and more particularly to a contact for electrically connecting chip module to a printed circuit board.

DESCRIPTION OF RELATED ART

A conductive contact 8 shown in FIGS. 1-2 assembled in a housing for connecting a chip module to a printed circuit board comprises a base portion 81', an elastic portion 82 extending from the base portion 81, and a securing portion 83 extending from an end of the base portion 81 and a contacting portion 84 extending from an end of the securing portion 843 for connecting with the printed circuit board. The securing portion defines a pair of barbs 831 for engaging with inner walls of the housing to securely holding the contact 8 in the housing. Referring to FIGS. 2-3, the barbs 831 of the securing portion is angled with an angle greater than 90.

However, when the contact 8 abovementioned is used for connecting the chip module to the printed circuit board, the open circuit or failure electrical connection usually occurs because the instable connection between components thereof. By analysis, the reason for invalid connection is usually associated to the connection character between the contacts 8 and the housing, and more practically to the interfering connecting effect between the barbs and the housing. In the contact above-mentioned, the barbs 831 of the securing portion 83 is angled with a vertical direction with greater than or equal to 90 degree, when the contact 8 is inserted into the housing, the material of the housing can not be fully filled into the clearance formed by the barbs 831, the base portion 81, and the securing portion 83, hence the holding force applied on the contact 8 is not enough to securely hold the contact 8 in the housing and prevent the connecting failure between the contact 8 and the housing.

Thus, there is a need to provide a new conductive contact that overcomes the above-mentioned problem.

SUMMARY OF THE INVENTION

An object of the present invention is to provide a conductive contact which can provide a reliable and stable connection between a chip module and printed circuit board.

In order to achieve above-mentioned object, a conductive contact of the present invention includes a right base portion, a securing portion extending from a lower end of the base portion, the securing portion defines at least one barb and the barb is bended with an angle less than 90.

Relative to the conventional contact, the contact defines at least one barb bended with a angle less than 90 to a vertical direction. So when the contact is inserted into the housing, the clearance formed by the barb, the base potion and the securing portion can be fully filled by the material of the passageways of the housing, which enhances the securely holding effect between the contact and the housing and prolongs the using life span of the electrical connector.

Other objects, advantages and novel features of the present invention will become more apparent from the following detailed description of the present embodiment when taken in conjunction with the accompanying drawings.

DETAILED DESCRIPTION OF THE INVENTION

Figure 1:
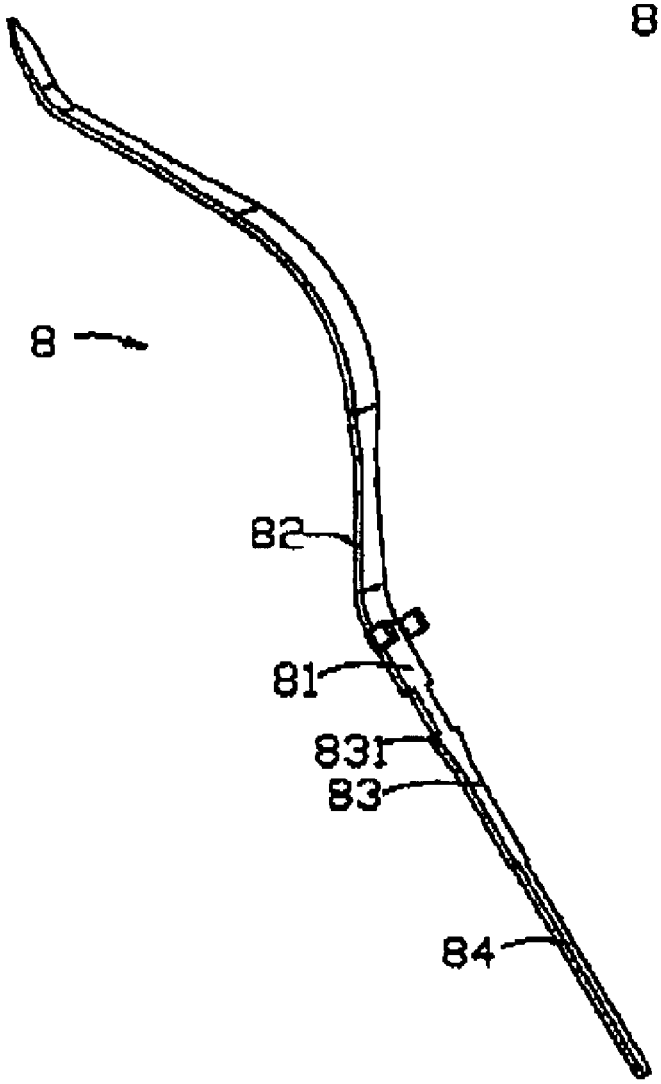
FIG. 1 is an isometric perspective view of a conventional conductive contact.
Figure 2:
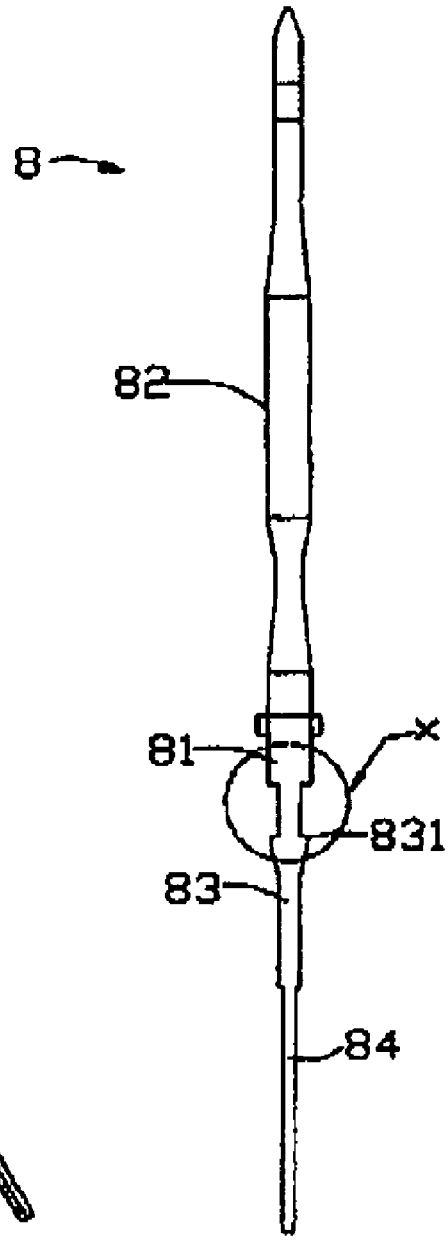
FIG. 2 (PRIOR ART)
FIG. 2 is another perspective view of the contact shown in FIG. 1.

Reference will now be made to the drawing figures to describe the preferred embodiment of the present invention in detail.

Figure 3:
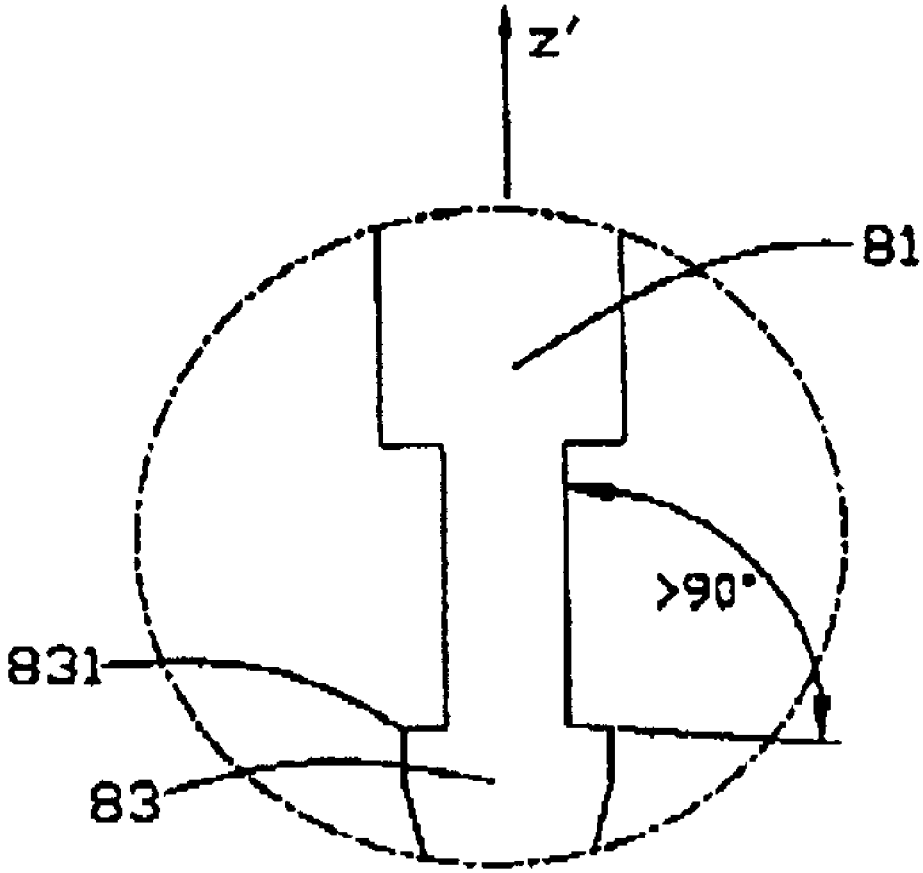
FIG. 3 (PRIOR ART)
FIG. 3 is a sectional enlarged view of Y circle shown in FIG. 2.
Figure 4:
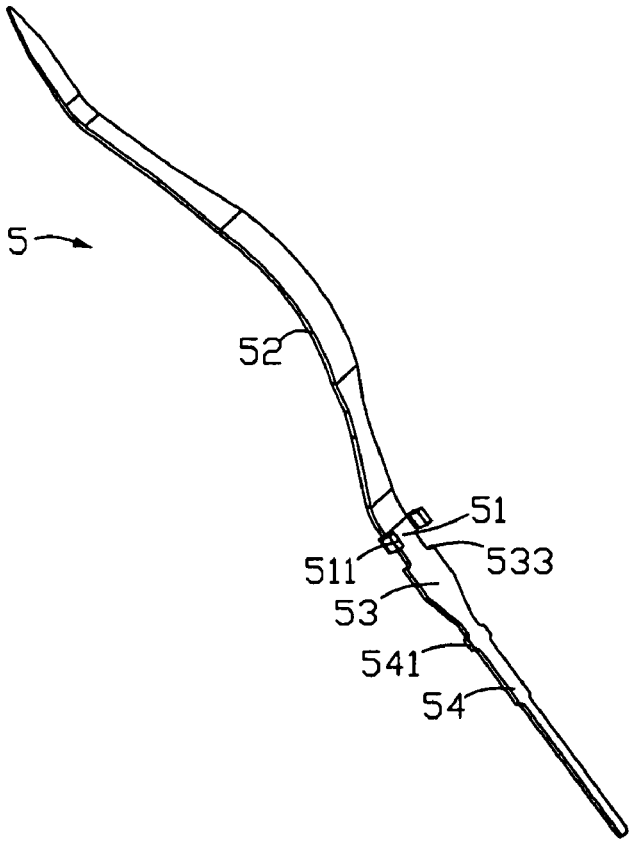
FIG. 4 is an exploded, isometric view of a contact in accordance with the embodiment of the present invention.
Figure 5:
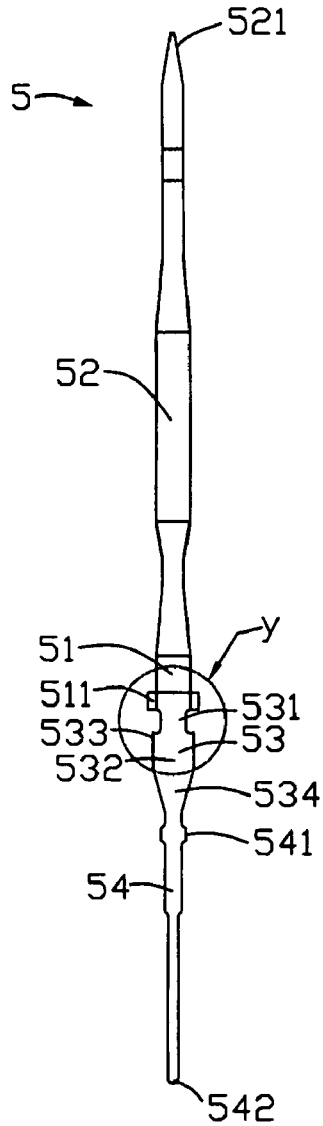
FIG. 5 is an another perspective view of the contact shown in FIG. 2.
Figure 6:
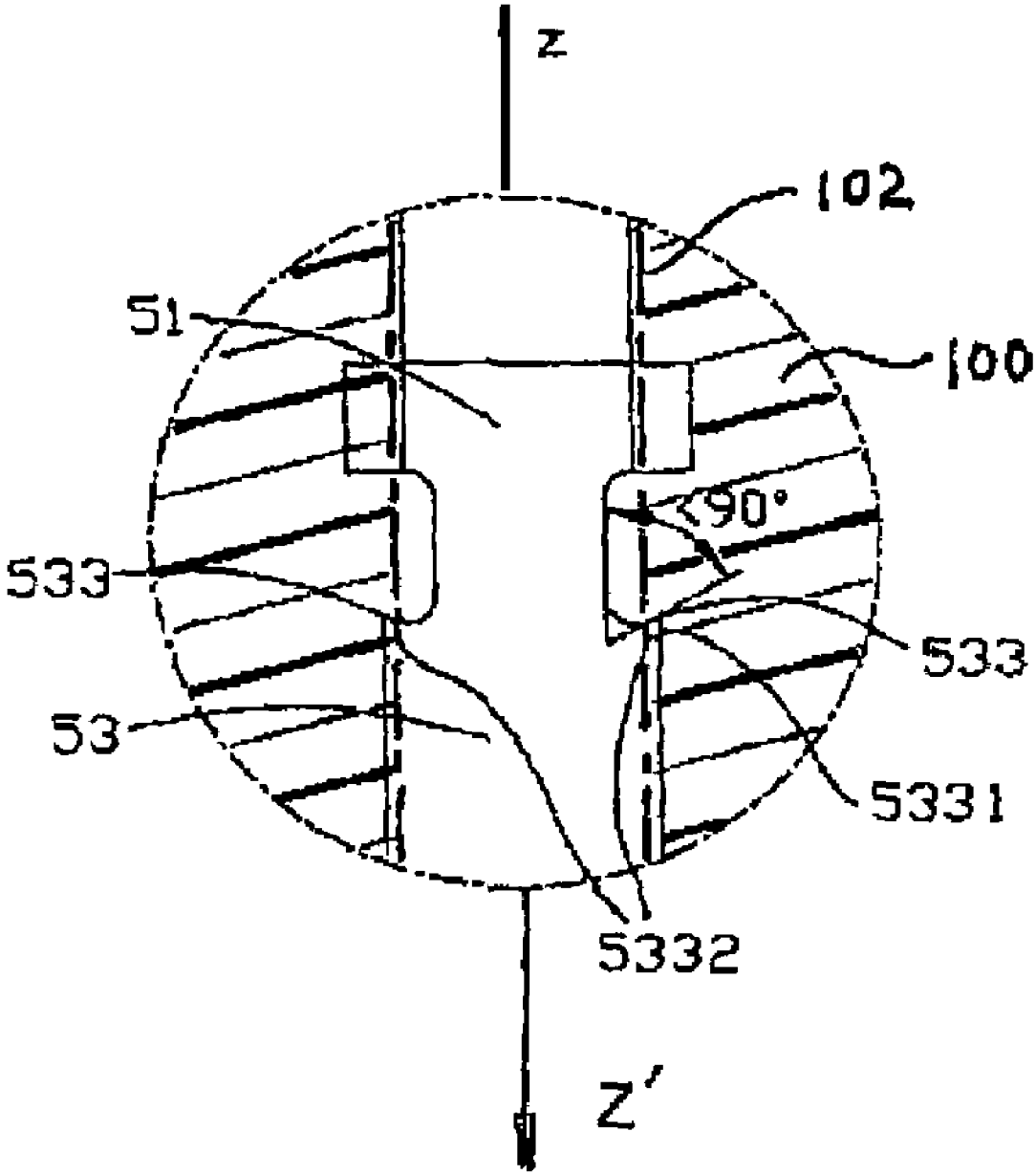
FIG. 6 is an sectional enlarged view of Y circle shown in FIG. 5.

Referring to FIGS. 3-5, a contact 5 in accordance with the present invention includes a base portion 51 extending along a right direction, an elastic portion 52 extending from an upper side of the base portion 51, a securing portion 53 extending upwardly from one side of the base portion 51, an inserting portion 54 extending from a lower end of the contact 5 for connecting to the printed circuit board.

The plate-like base portion 51 extends along a right direction and comprises a pair of extending portion 511 extending from two opposite sides of the base portion 51 for preventing the contact from deforming when the contact 5 is inserted into the housing.

The elastic portion 52 curved extends from an upper end of the base portion 51 and includes a sharp portion 521 formed on a distal end thereof. When the contact 5 is assembled into the housing, the sharp portion 521 extends beyond an upper surface of the housing for getting a contact with the chip module.

The securing portion 53 extends from the base portion 51 and comprises a transitional portion 531 with a width less than that of the base portion 51 and a retaining portion 532 connecting with the transitional portion 531 defining a pair of barbs 533 for engaging with the housing. The barb 533 forms an angle less than 90 degree with the base portion 51 and the transitional portion 531. In addition, the securing portion 53 comprises a connecting portion 534 extending form the retaining portion 532 with a decreasing width in an upper to lower direction.

The inserting portion 54 extends from a lower end of the securing portion 53 and comprises a pair of anchoring portions 541 extending outwardly from the two opposite sides of the inserting portion 54 adjacent to the securing portion 53 for enforcing the securely holding effect between the contact 5 and the housing. In addition, width of the securing portion 51 is wider than that of the base portion 51, and the securing portion 51 defines a plurality of anchoring portions 541 for engaging with a housing of an electrical connector. The inserting portion 54 defines a contacting portion 542 extending from a distal end thereof for extending beyond a lower surface of the housing to contact with the printed circuit board.

In this embodiment, the contact 5 is inserted into the passageways 102 of the housing 100, the elastic portion 52 and the inserting portion 54 are received in the passageway and the barbs 533 of the securing portion 53 are inserted into the passageway and interferingly engaging with the housing, and the materials of the housing is fully filled into the clearance formed by the barbs 51, the transitional portion 531 and the securing portion 53. For the angle between the barbs 533 and the vertical direction Z is less then 90 degree, the contact 5 resided in the housing can be more securely holding and the electrical connection effect between the housing and the contact 5 becomes more secure than ever.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining at least one passageway;

a conductive contact inserted into the passageway in an insertion direction and received in the passageway, and including:

a base portion;

a securing portion formed on the base portion; wherein the securing portion defines a recess indented in a side edge region thereof so as to be able to be fully filled by material of the housing; wherein said recess is formed among a front acute angular barb thereof and a rear laterally extending portion along the insertion direction and a transitional portion connected therebetween; wherein the rear laterally extending portion is dimensioned larger than the front barb in a lateral direction perpendicular to said insertion direction; and an acute angle is formed by and between the front barb and the transitional portion, outwardly facing said recess; wherein the front barb includes an outer edge section extending in a parallel manner along the insertion direction, and said acute angle is formed by an inner edge section of the front barb and a direction opposite to said insertion direction and further including pair of extending portions perpendicularly extending from two opposite sides of the rear laterally extending portion and directly confronting said recess in said insertion.

2. The electrical connector as claimed in claim 1, wherein said transitional portion defines a length along the insertion direction and a width in said transverse direction, said length being smaller than said width.

3. The electrical connector as claimed in claim 1, wherein the transitional portion defines an edge facing said recess and extending in said insertion direction.

4. An electrical connector comprising;

an insulative housing defining at least one passageway;

a conductive contact inserted into the passageway in an insertion direction and received in the passageway, and including:

a base portion;

a securing portion formed on the base portion; wherein the securing portion defines a recess indented in a side edge section thereof so as to be able to be fully filled by material of the housing; wherein said recess is formed among a front acute angular barb and a rear laterally extending portion along the insertion direction and a transitional portion connected therebetween; wherein the rear laterally extending portion is dimensioned larger than the front barb in a lateral direction perpendicular to said insertion direction; and an acute angle is formed by and between an inner edge of the barb and a direction opposite to the insertion direction, outwardly facing said recess; wherein the barb further includes an outer edge extending in a parallel manner along the insertion direction.

5. The electrical connector as claimed in claim 4, wherein the transitional portion defines a side edge facing the recess and extending along said insertion direction and further including pair of extending portions perpendicularly extending from two opposite sides of the rear laterally extending portion and directly confronting said recess in said insertion.

6. The electrical connector as claimed in claim 4, wherein said transitional portion defines a length along the insertion direction and a width in said lateral direction, said length being smaller than said width.

* * * * *